US007028591B2

(12) United States Patent
Dallas et al.

(10) Patent No.: US 7,028,591 B2
(45) Date of Patent: Apr. 18, 2006

(54) MULTI-FUNCTION TOOL WITH SPRING BIASED IMPLEMENT

(75) Inventors: Edgar A. Dallas, Beaverton, OR (US); Edward M. Wallace, Jr., Portland, OR (US); John A. Nason, Kelzer, OR (US); Phillip A. Montague, Tualatin, OR (US)

(73) Assignee: Fiskars Brands, Inc., Madison, WI (US)

( * ) Notice: Subject to any disclaimer, the term of this patent is extended or adjusted under 35 U.S.C. 154(b) by 0 days.

(21) Appl. No.: 10/356,385

(22) Filed: Jan. 31, 2003
(Under 37 CFR 1.47)

(65) Prior Publication Data

US 2004/0003472 A1 Jan. 8, 2004

Related U.S. Application Data

(60) Provisional application No. 60/353,830, filed on Jan. 31, 2002, provisional application No. 60/414,824, filed on Sep. 30, 2002.

(51) Int. Cl.
*B25B 7/00* (2006.01)

(52) U.S. Cl. ..... 81/300; 7/125

(58) Field of Classification Search ..... 7/125, 7/158, 127, 128; 30/152, 162, 154; 81/427.5, 81/300

See application file for complete search history.

(56) References Cited

U.S. PATENT DOCUMENTS

| | | | | |
|---|---|---|---|---|
| 4,502,220 | A * | 3/1985 | Aoki | 30/154 |
| 4,794,692 | A * | 1/1989 | Wang | 30/123 |
| 5,142,721 | A | 9/1992 | Sessions et al. | |
| 5,357,678 | A * | 10/1994 | Wei | 30/255 |
| 5,657,543 | A | 8/1997 | Collins | |
| 5,689,886 | A * | 11/1997 | Yeh | 30/162 |
| 5,829,329 | A | 11/1998 | Frazer | |
| 6,070,504 | A | 6/2000 | Frazer | |
| 6,088,860 | A | 7/2000 | Poehlmann et al. | |
| 6,185,771 | B1 * | 2/2001 | Trusty, Sr. | 7/128 |
| 6,487,778 | B1 * | 12/2002 | Gringer et al. | 30/162 |

FOREIGN PATENT DOCUMENTS

DE 91 03 496 6/1991

OTHER PUBLICATIONS

International Search Report mailed Jul. 21, 2003, App. No. PCT/US03/02968.

* cited by examiner

*Primary Examiner*—Jacob K. Ackun
*Assistant Examiner*—Jamila O. Williams
(74) *Attorney, Agent, or Firm*—Foley & Lardner LLP

(57) ABSTRACT

A multi-function tool includes a pair of handles and an implement slidably coupled to the handles. The implement is configured to slide in a linear fashion between a stowed position and a deployed position. A bias mechanism is coupled to the implement such that the bias mechanism biases the implement in the direction of the deployed position.

22 Claims, 4 Drawing Sheets

MULTI-FUNCTION TOOL WITH SPRING BIASED IMPLEMENT

CROSS-REFERENCE TO RELATED APPLICATIONS

This application claims the benefit of U.S. Provisional Application No. 60/353,830, filed Jan. 31, 2002, and U.S. Provisional Application No. 60/414,824, filed Sep. 30, 2002, both of which are incorporated herein by reference in their entirety.

FIELD OF THE INVENTION

The present invention relates to a hand tool having a spring biased implement. More specifically, the present invention relates to a multi-function tool having a spring biased implement slidably attached to a pair of handles.

BACKGROUND OF THE INVENTION

Multi-function tools typically include a pair of handles and an implement such as a pair of scissors or pliers, along with a number of pivotally attached ancillary tools used to perform a number of tasks. The multi-function tool generally has a compact configuration in which the implement is stowed within the handles, and a deployed position in which the implement is extended from the tool and ready for use.

Conventional multi-function tools utilize a number of configurations intended to provide a stowed position and a deployed position for the implement. One such configuration involves attaching each of the handles in a pivotal manner to the implement such that the handles are rotated about the implement to either house the implement between the handles or position the implement in a ready-to-use orientation. Another such configuration involves slidably attaching the implement to a pair of handles such that the implement slides between the stowed and deployed positions. An example of the sliding configuration is disclosed in U.S. Pat. No. 6,088,860 "Pocket Tool with Removable Jaws" to Poehlmann et al., which is herein incorporated by reference in its entirety.

In certain conventional embodiments of multi-function tools having an implement with stowed and deployed configurations, the user must perform several mechanical steps to deploy the implement. The steps may require the use of both hands by the user, and may also be time consuming, depending on the complexity of the operation.

In many circumstances, it would be advantageous for a multi-function tool to have an implement that may be deployed using one hand. For example, the user may be holding a second tool in the opposite hand, or may be performing some task with the opposite hand that precludes its use in deploying the implement of the multi-function tool. For example, a fisherman may be holding fishing gear in the left hand and may wish to use an implement such as pliers or a scissors with the right hand without undue delay.

It would further be advantageous for a multi-function tool to have a method of deploying the implement that is of reduced complexity. While certain multi-function tools may permit the deployment of an implement using one hand, the method of deployment may be too complex to permit the operation when the user is wearing gloves or has otherwise reduced mobility of the hand.

It would also be advantageous for a multi-function tool to permit deployment of the implement in a timely fashion.

There are occasions when the user requires use of the implement immediately, such as when removing a hook from a fish that is to be released, when the user does not have the time to perform a time-consuming implement deployment process.

Certain multi-function tool embodiments include a handle portion that swings through an arc along with the implement to deploy the implement. The handle and implement may be biased with a spring to permit one-handed deployment of the implement. It would be advantageous to provide a design that does not require such pivotal motion of the handles and implement.

It would be desirable to have a tool that provides one or more of these or other advantageous features. Other features and advantages will be made apparent from the present specification. The teachings disclosed extend to those embodiments that fall within the scope of the claims, regardless of whether they accomplish one or more the aforementioned needs.

SUMMARY OF THE INVENTION

The invention relates to a multi-function tool having a pair of handles and an implement slidably coupled to the handles. The implement is configured to slide in a linear fashion between a stowed position and a deployed position. A bias mechanism is coupled to the implement such that the bias mechanism biases the implement in the direction of the deployed position.

The invention further relates to a multi-function tool having a first handle, a second handle, and a pair of pliers having a first tang and a second tang. The first tang is slidably coupled to the first handle and the second tang is slidably coupled to the second handle. A spring is coupled between at least one of the handles and the pliers, and the spring slides the pliers from a stowed position into a deployed position.

The invention further relates to a multi-function tool having a pair of handles pivotally coupled to one another and an implement slidably attached to the pair of handles. A pair of springs is coupled between the implement and the handles and biases the implement into a deployed position. A lock is configured to maintain the tool in at least one of a stowed position and the deployed position.

Another exemplary embodiment relates to a method of deploying an implement of a multi-function tool. The method includes the steps of providing a handle having an implement slidably attached thereto, providing a spring mechanism coupled between the implement and the handle, and actuating a lock release button to permit the implement to slide from a stowed position into a deployed position.

The invention is capable of other embodiments and of being practiced or being carried out in various ways. It is to be understood that the invention is not limited in its application to the details of construction and the arrangements of components set forth in the following description or illustrated in the drawings. Alternative exemplary embodiments relate to other features and combinations of features as may be generally recited in the claims.

BRIEF DESCRIPTION OF THE DRAWINGS

The invention will become more fully understood from the following detailed description, taken in conjunction with the accompanying drawings, where like reference numerals refer to like elements, in which.

DETAILED DESCRIPTION OF PREFERRED AND OTHER EXEMPLARY EMBODIMENTS

Figure 1:
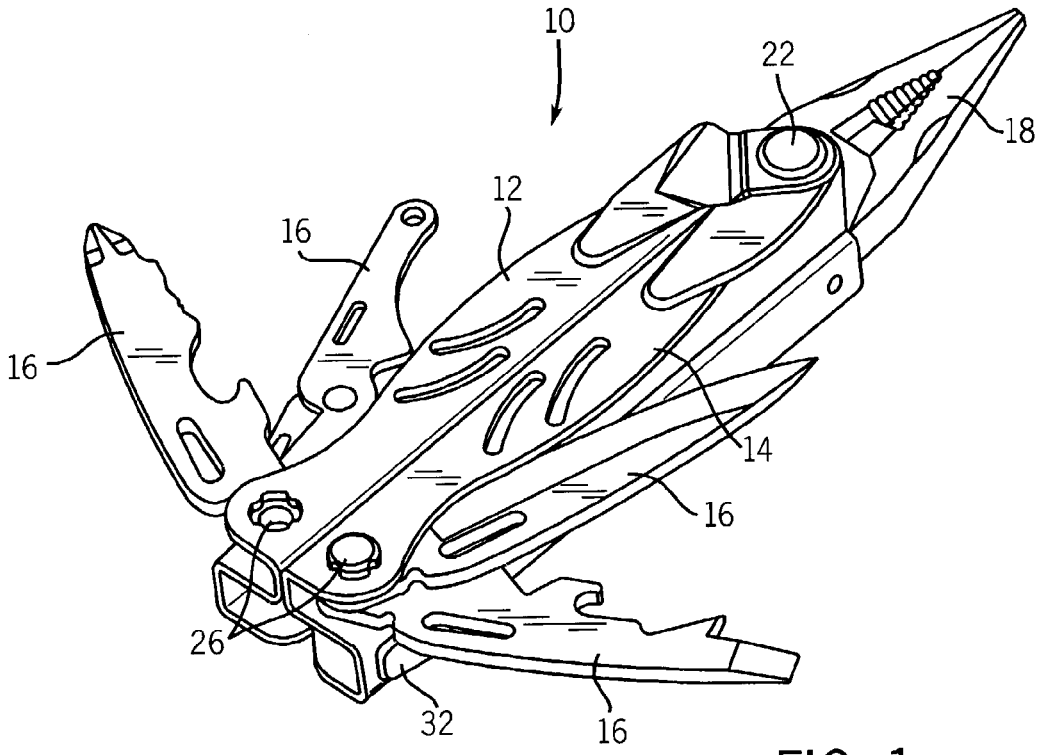
FIG. 1 is a perspective view of a multi-function tool having an implement in a deployed position.

Referring to FIG. 1, a multi-function tool, shown as, but not limited to, multi-function tool 10, may include a pair of handles 12, 14, a number of ancillary tools 16 pivotally attached to one or both handles 12, 14, and an implement 18 also coupled to the handles 12, 14. In the embodiment depicted in FIG. 1, the implement 18 is a pair of pliers, but could also be other types of implements such as scissors or a wrench. The implement 18 is shown in a deployed position in FIG. 1.

Figure 2:
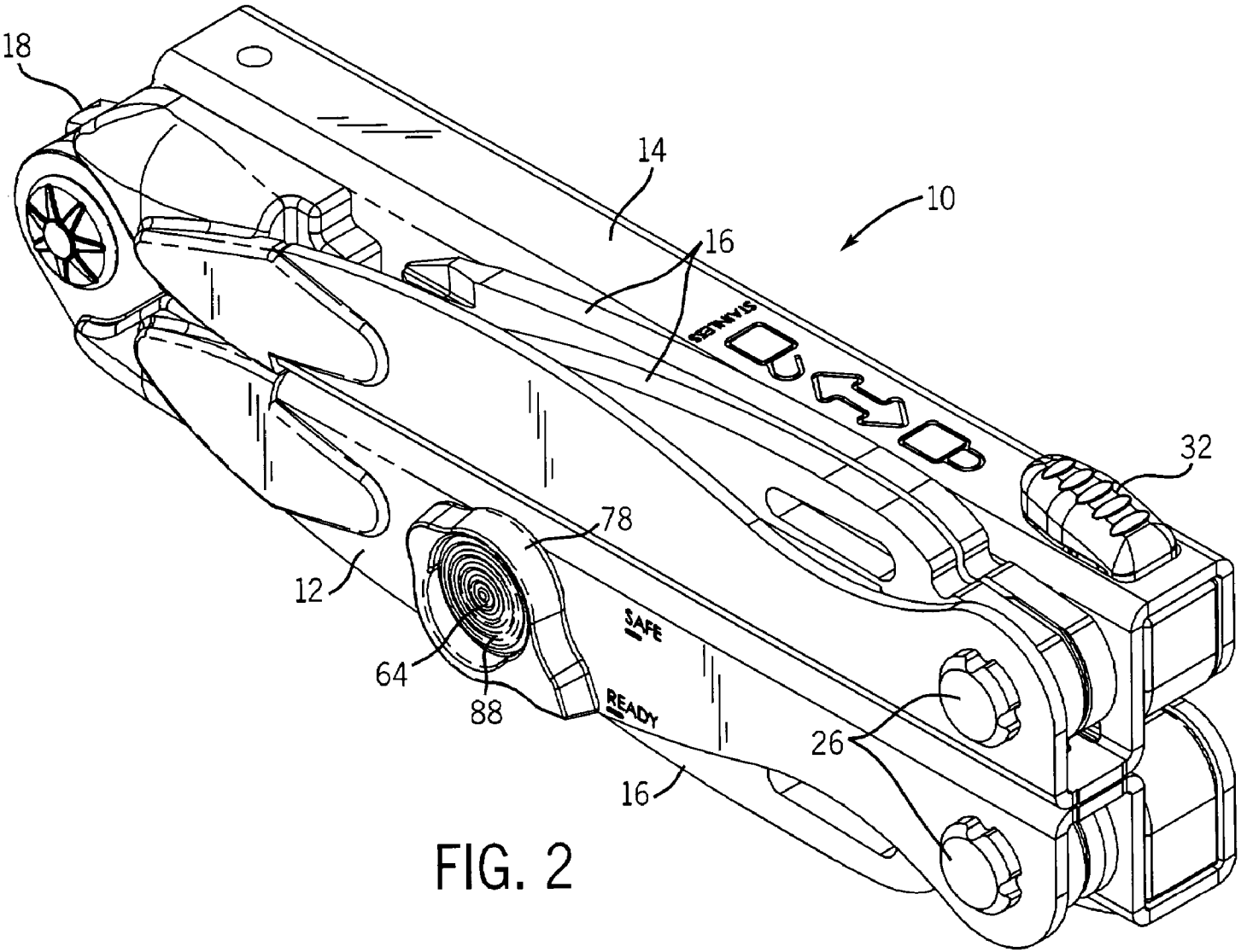
FIG. 2 is a perspective view of a multi-function tool having an implement in a stowed position.

Referring to FIG. 2, multi-function tool 10 may have a compact configuration in which the implement 18 is stowed within the handles 12, 14. The compact configuration is useful for storing the multi-function tool 10 when not in use, permitting the carrying in a pocket or attaching to a belt.

Further referring to FIG. 2, one or more ancillary tools 16 may be available for use when multi-function tool 10 is in the compact configuration. In such an embodiment, one or both handles 12, 14 may have a channel configured to house the ancillary tools 16, the channel open toward the exterior of the multi-function tool 10 permitting the user to pivotally open and close ancillary tools 16 when multi-function tool 10 is in the compact configuration. FIG. 1 depicts the ancillary tools 16 disposed in partially opened positions.

Referring to FIG. 1, in an exemplary embodiment, handles 12, 14 are pivotally connected to one another at a first end 22. Many suitable fasteners are known for pivotally connecting the handles 12, 14 together. At the other end of the handles 12, 14, tool axles 26 may extend through one or both channel shaped handles 12, 14 to pivotally couple ancillary tools 16 to the handles 12, 14. Exemplary types of ancillary tools 16 that may be coupled to handles 12, 14 include blades, screwdrivers, bottle openers, can openers, scissors, nail files, box openers, and the like.

Figure 3:
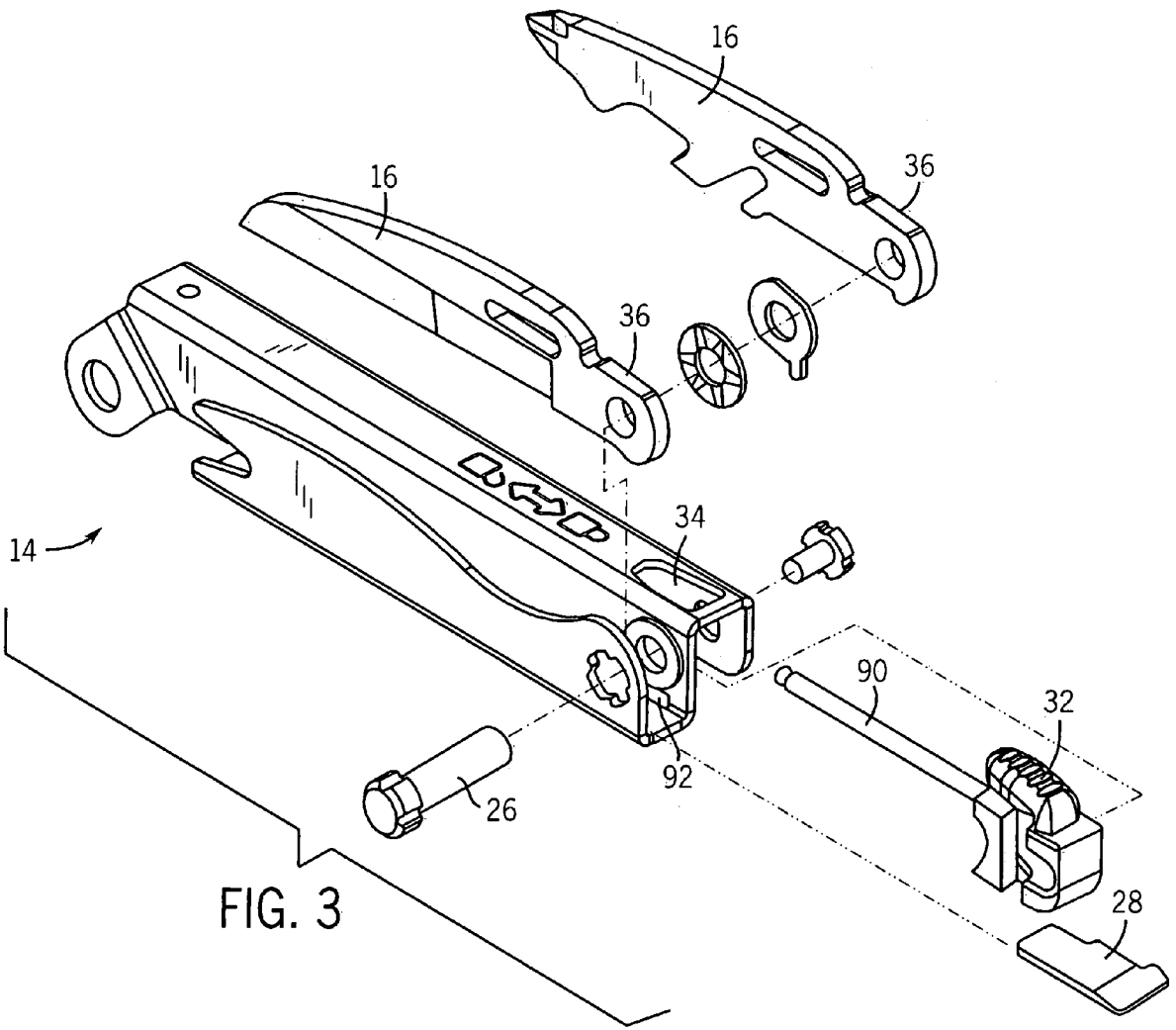
FIG. 3 is an exploded view of a handle of a multi-function tool having a spring biased implement.

Referring to FIG. 3, ancillary tools 16 may be biased in a closed position or locked in an open position by a lock, shown as wedge lock 28, disposed within one or both of the handles 12, 14. Such a wedge lock mechanism is generally described in U.S. Pat. No. 6,088,860. A lock release button 32 is coupled to the wedge lock 28 and is used to disengage the wedge lock 28 to permit closing of ancillary tool 16. When an ancillary tool 16 is in an open position, wedge lock 28 engages locking surface 36 to lock ancillary tool 16 in the open position. Lock release button 32 extends through an aperture 34 in handle 14 (and similarly in handle 12) and slides within the aperture 34 to disengage/engage the wedge lock 28. Wedge lock 28 is typically biased into the engaged position by a spring (not shown).

Figure 4:
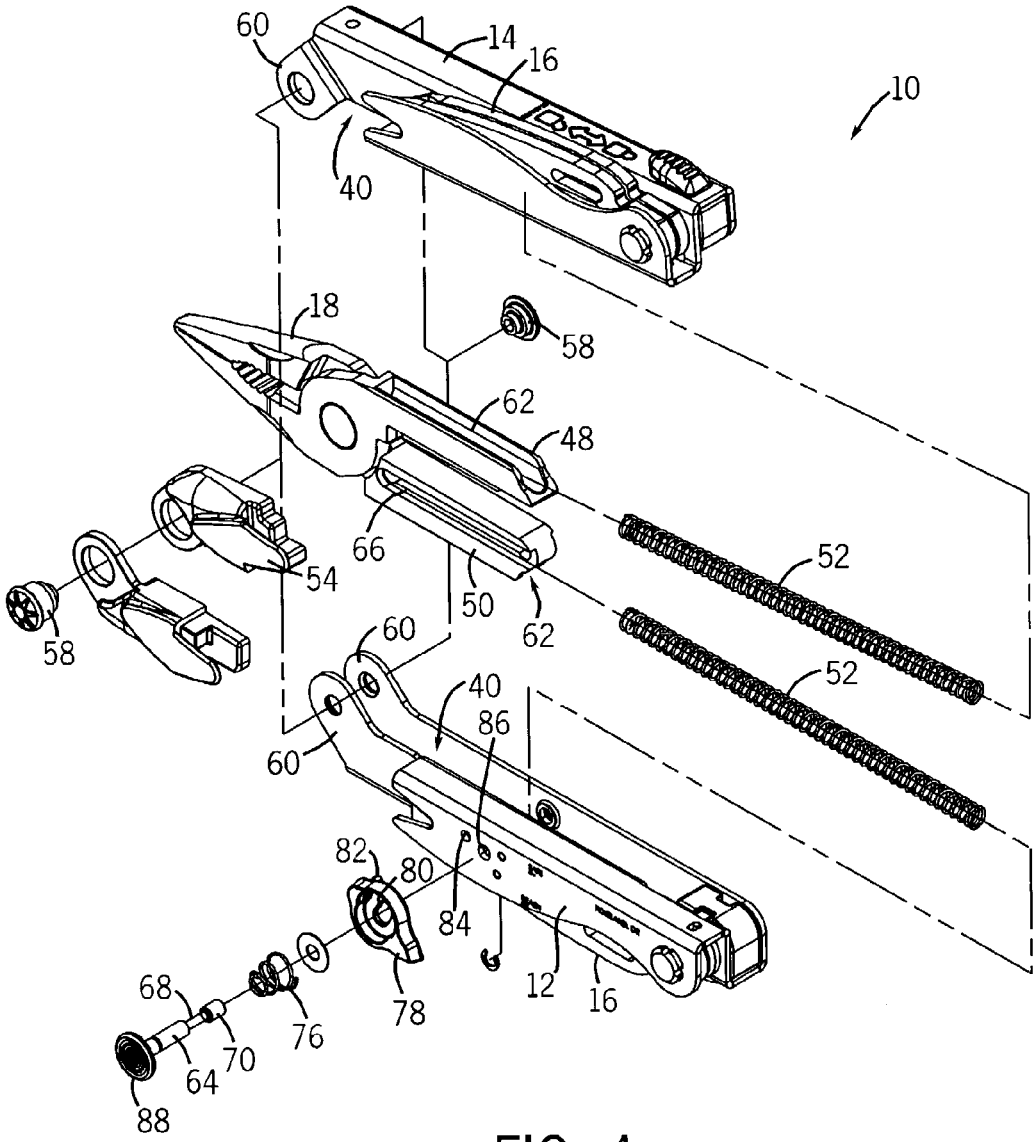
FIG. 4 is an exploded perspective view of a multi-function tool having a spring biased implement.

Referring to FIG. 4, in an exemplary embodiment, multi-function tool 10 includes a spring biased implement. Handles 12, 14 house ancillary tools 16 without interfering with the implement 18, which is slidably attached to handles 12, 14. A center channel 40 in each handle 12, 14 houses and permits sliding motion of implement 18.

In the embodiment depicted in FIG. 4, implement 18 is a pair of pliers having a pair of tangs 48, 50. A bias mechanism, shown as, but not limited to, jaw slide springs 52 may be attached between the implement 18 and the handles 12, 14. The jaw slide springs 52 are coil springs that bias the implement 18 in the deployed position such that when released, the implement 18 slides within the center channels 40 from the stowed position to the deployed position. The bias mechanism depicted in FIG. 4 is exemplary, and is not intended to limit the manner in which implement 18 may be biased into the deployed or stowed positions. For example, different types of springs other than jaw slide springs 52 could be used, and the springs could be attached between the implement 18 and handles 12, 14 in a different manner.

Referring to FIG. 3, in an exemplary embodiment, a spring guide 90 is attached to the lock release button 32. The spring guide 90 extends into the channel 40 and receives the jaw slide spring 52 associated with that handle. A similar configuration may be utilized in the opposite handle. The spring guide 90 aids in preventing the jaw slide spring 52 from deforming upon the compression that results when the implement 18 is in the stowed position. Note that the spring guide 90 and associated lock release button 32 are housed within center channel 40 while the ancillary tools 16 are housed alongside the center channel 40. The lock release button 32 is configured to engage the wedge lock 28 via a slot 92 between the two channels as depicted in FIG. 3.

Further referring to FIG. 4, in an exemplary embodiment, handle sides 12, 14 are pivotally coupled to one another by a pair of handle rivets 58 that extend through end caps 54 disposed on end portions 60 of handles 12, 14. End caps 54 may be constructed of plastic and slidably affixed to each of the end portions 60 before being secured by handle rivets 58.

In an exemplary embodiment, handles 12, 14 may be biased apart from one another by torsion springs (not shown), disposed between end caps 54. Other mechanical methods of biasing handles 12, 14 are within the scope of the invention, such as including a spring within the implement (not shown) to bias the jaws, and therefore the handles apart from one another.

Figure 5:
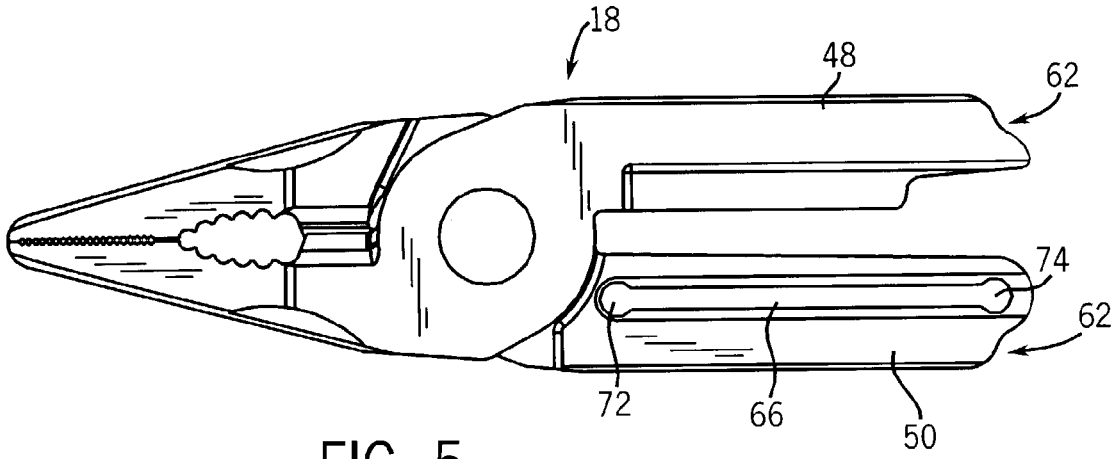
FIG. 5 is a front elevation view of an implement of a multi-function tool.

Referring to FIGS. 3–5, according to an exemplary embodiment of the invention, jaw slide springs 52 are received in channels 62 in the tangs 48, 50. A lock, shown as, but not limited to, jaw lock pin 64 extends through one or both handles 12, 14 into a corresponding pin slot 66 in tang 50. Jaw lock pin 64 has a narrow portion 68 sized to slide freely within in slot 66, permitting implement 18 to slide between the stowed and deployed positions. An enlarged portion 70 of the pin 64 has a larger diameter than the width of slot 66.

Referring to FIGS. 4 and 5, one or both sides of pin slot 66 may include an enlarged aperture 72, 74, permitting the pin 64 to lock the implement 18 into either or both the retracted and deployed positions. The locking function is accomplished by having the enlarged portion 70 of pin 64 extend into one of enlarged apertures 72, 74 thus preventing movement of the implement 18 relative to the pin 64 (as contrasted with the freely slidable configuration when the narrow portion 68 of pin 64 extends through slot 66).

A spring such as lock spring 76 may be applied to pin 64 to bias the pin 64 into the locked position (outward from handle 12 in the embodiment of FIG. 4) such that when the implement 18 reaches either end of its travel, it locks into place until the user depresses the pin 64 to release the implement 18. Referring to FIG. 5, when the enlarged portion 70 extends through aperture 72, the implement is locked in the stowed position and when the enlarged portion 70 extends through aperture 74, the implement is locked in the deployed position.

In the embodiment of FIG. 4, the user is required to depresses the jaw lock pin 64 to effectuate the sliding motion of implement 18 into or out of the handles 12, 14. When pin 64 is not depressed, the spring 76 forces pin 64 out of the handle 12 such that the enlarged portion 70 automatically engages one of enlarged apertures 72, 74 when implement 18 reaches the end of its travel. In one embodiment, jaw slide springs 52 are compressed when implement 18 is placed into the retracted position by the user. The location of channel 62 in tang 50 is intended to not interfere with pin slot 66, which permits travel of pin 64.

Further, referring to FIG. 4, in an exemplary embodiment, the multi-function tool may include a lock safety button, shown as safety switch 78, that prevents unintended actuation of the jaw lock pin 64. The safety switch 78 receives the pin 64 through a pin aperture 80 and is pivotally attached to handle 12 via engagement between a post 82 and a corresponding handle aperture 84. Because the pin 64 is constrained within the handle 12 by aperture 86, rotation of the safety switch 78 results in movement of the pin 64 within pin aperture 80, which is a curvilinear slot designed to permit such movement. When the safety switch 78 is in the "READY" position (see FIG. 2), the pin head 88 may be depressed by the user, forcing the pin 64 into handle 12 against the bias of spring 76, thus disengaging the enlarged portion 70 from either enlarged aperture 72, 74, permitting movement of the implement 18. When the safety switch 78 is in the "SAFE" position, the interior contour of the safety switch 78 interferes with movement of the pin head 88, whereby the pin 64 may not be depressed by the user until the safety switch 78 is disengaged. Accordingly, the safety switch prevents unintended actuation of the pin 64.

The exemplary embodiments described herein possess the advantageous features described in the Background of the Invention section because a user may easily deploy an implement from a multi-function tool via an engagement mechanism, such as by depressing a pin. Further, the deployment may be accomplished with one hand by the user and may be accomplished even if the user is wearing gloves. Further, the spring-aided deployment of the implement is quickly accomplished such that the user may immediately begin using the multi-function tool after retrieval of the multi-function tool, without having to first take the time to manually deploy the implement.

While the detailed drawings, specific examples, and particular formulations given describe preferred and exemplary embodiments, they serve the purpose as illustration only. The inventions disclosed are not limited to the specific forms shown. The configuration of multi-function tool may differ depending on chosen performance characteristics and physical characteristics of the components of the multi-function tool. For example, the implement may take a variety of configurations and perform different functions depending on the needs of the user, and the method of attaching the jaw slide springs to the implement may vary. Further, the bias mechanism may pull the implement into the deployed position, such as by using an extension spring, as opposed to pushing the implement with a coil spring as in the case of the embodiment shown in FIG. 4. Further still, the bias mechanism may bias the implement into the stowed position rather than the deployed position. Furthermore, other substitutions, modifications, changes, and omissions may be made in the design, operating conditions, and arrangement of the exemplary embodiments without departing from the scope of the invention as expressed in the appended claims.

What is claimed is:

1. A multi-function tool, comprising:

a pair of handles;

an implement slidably coupled to the handles, the implement configured to slide in a linear fashion between a stowed position and a deployed position;

a bias mechanism coupled to the implement, wherein the bias mechanism biases the implement in the direction of the deployed position; and a lock configured to lock the implement in the stowed position, wherein when the lock is disengaged, the bias mechanism slides the implement into the deployed position, wherein the lock comprises a pin extending into a pin slot in the implement, the pin slot having an enlarged aperture configured to receive an enlarged portion of the pin, the enlarged portion of the pin being unable to slide within the pin slot, whereby the implement is locked into position when the enlarged portion of the pin extends into the enlarged aperture.

2. The multi-function tool of claim 1, wherein the pin is biased into the locked position by a spring.

3. The multi-function tool of claim 1, wherein the lock is disengaged by depressing a head of the pin.

4. A multi-function tool, comprising:

a pair of handles;

an implement slidably coupled to the handles, the implement configured to slide in a linear fashion between a stowed position and a deployed position;

a bias mechanism coupled to the implement, wherein the bias mechanism biases the implement in the direction of the deployed position;

a lock configured to lock the implement in the stowed position, wherein when the lock is disengaged, the bias mechanism slides the implement into the deployed position; and a lock safety button rotatably coupled to one of the handles, wherein the lock safety button is configured to prevent accidental disengagement of the lock.

5. The multi-function tool of claim 1, wherein the lock further locks the implement into the deployed position.

6. The multi-function tool of claim 1, further comprising a second enlarged aperture in the pin slot, the second enlarged aperture configured to receive the enlarged portion of the pin when the implement is in the deployed position, thereby locking the implement in the deployed position.

7. A multi-function tool, comprising:

a first handle and a second handle;

a pair of pliers having a first tang and a second tang, the first tang slidably coupled to the first handle and the second tang slidably coupled to the second handle;

a spring coupled between at least one of the handles and the pliers, wherein the spring slides the pliers from a stowed position into a deployed position, wherein the spring pushes the implement into the deployed position; and a lock configured to lock the pliers in the stowed position, wherein when the lock is disengaged, the spring slides the pliers into the deployed position.

8. A multi-function tool, comprising:

a first handle and a second handle;

a pair of pliers having a first tang and a second tang, the first tang slidably coupled to the first handle and the second tang slidably coupled to the second handle; and a spring coupled between at least one of the handles and the pliers, wherein the spring slides the pliers from a stowed position into a deployed position and wherein the spring pushes the implement into the deployed position.

9. A multi-function tool, comprising:

a first handle and a second handle;

a pair of pliers having a first tang and a second tang, the first tang slidably coupled to the first handle and the second tang slidably coupled to the second handle;

a spring coupled between at least one of the handles and the pliers, wherein the spring slides the pliers from a stowed position into a deployed position; and a second spring coupled between the other of the handles and the pliers.

10. A multi-function tool, comprising:

a first handle and a second handle;

a pair of pliers having a first tang and a second tang, the first tang slidably coupled to the first handle and the second tang slidably coupled to the second handle;

a spring coupled between at least one of the handles and the pliers, wherein the spring slides the pliers from a stowed position into a deployed position; and a lock configured to lock the pliers in the stowed position, wherein when the lock is disengaged, the spring slides the pliers into the deployed position, wherein the lock comprises a pin extending into a pin slot in the first tang, the pin slot having an enlarged aperture configured to receive an enlarged portion of the pin, the enlarged portion of the pin being unable to slide within the pin slot, whereby the pliers are locked into position when the enlarged portion of the pin extends into the enlarged aperture.

11. The multi-function tool of claim 10, wherein the pin is biased into the locked position by a lock spring.

12. The multi-function tool of claim 10, wherein the lock is disengaged by depressing a head of the pin.

13. A multi-function tool, comprising:

a first handle and a second handle;

a pair of pliers having a first tang and a second tang, the first tang slidably coupled to the first handle and the second tang slidably coupled to the second handle;

a spring coupled between at least one of the handles and the pliers, wherein the spring slides the pliers from a stowed position into a deployed position; and a lock configured to lock the pliers in the stowed position, wherein when the lock is disengaged, the spring slides the pliers into the deployed position; and a lock safety button coupled to one of the handles, wherein the lock safety button is configured to prevent accidental disengagement of the lock.

14. The multi-function tool of claim 7, wherein the lock further locks the implement into the deployed position.

15. The multi-function tool of claim 10, further comprising a second enlarged aperture in the pin slot, the second enlarged aperture configured to receive the enlarged portion of the pin when the pliers are in the deployed position, thereby locking the pliers in the deployed position.

16. A multi-function tool, comprising:

a pair of handles pivotally coupled to one another;

an implement slidably attached to the pair of handles, the implement having an extended deployed position and a retracted stowed position;

a pair of springs coupled between the implement and the handles and biasing the implement into the deployed position; and a lock configured to maintain the tool in at least one of the stowed position and the deployed position, wherein when the lock is disengaged, the springs slide the implement into the deployed position.

17. The multi-function tool of claim 16, wherein the implement is a pair of pliers.

18. The multi-function tool of claim 16, wherein the pair of springs push the implement into the deployed position.

19. The multi-function tool of claim 16, wherein the lock comprises a pin coupled to the implement, the pin having a locked position wherein the pin interferes with travel of the implement.

20. The multi-function tool of claim 19, wherein the pin is biased into the locked position by a lock spring.

21. The multi-function tool of claim 20, wherein the lock is disengaged by depressing a head of the pin.

22. The multi-function tool of claim 19, further comprising a lock safety button coupled to the pin, wherein the lock safety button is configured to prevent release of the pin from the locked position.

* * * * *